US006772789B1

(12) United States Patent
Terry, III et al.

(10) Patent No.: US 6,772,789 B1
(45) Date of Patent: Aug. 10, 2004

(54) FLOW LEVELING DEVICE

(75) Inventors: Theophilus B. Terry, III, Hodgenville, KY (US); Michael J. Hornback, Louisville, KY (US)

(73) Assignee: Harry L. Nurse, Jr., Goshen, KY (US)

( * ) Notice: Subject to any disclaimer, the term of this patent is extended or adjusted under 35 U.S.C. 154(b) by 289 days.

(21) Appl. No.: 10/124,921

(22) Filed: Apr. 18, 2002

(51) Int. Cl.[7] ..... E03R 11/00

(52) U.S. Cl. ..... 137/577; 210/170; 210/532.2; 285/148.27; 405/80; 405/87

(58) Field of Search ..... 137/577; 210/170, 210/532.2, 533, 536; 285/148.27, 148.4, 272, 331; 405/39, 40, 80, 87, 88, 90

(56) References Cited

U.S. PATENT DOCUMENTS

| | | | | |
|---|---|---|---|---|
| 278,723 A | | 6/1883 | Monteath | |
| 360,168 A | | 3/1887 | McMahon | |
| 1,103,391 A | | 7/1914 | Armsworth | |
| 1,123,888 A | | 1/1915 | Kempf | |
| 1,248,058 A | | 11/1917 | Bailey | |
| 1,304,980 A | * | 5/1919 | Hirshstein | 285/148.27 |
| 1,394,780 A | | 10/1921 | Nicholas | |
| 1,402,645 A | * | 1/1922 | Peress | 285/148.27 |
| 1,564,927 A | * | 12/1925 | Ballard | 405/90 |
| 1,711,761 A | * | 5/1929 | Warren et al. | 285/148.4 |
| 2,364,133 A | * | 12/1944 | De La Roza | 285/148.27 |
| 2,547,567 A | | 4/1951 | Collison | |
| 2,891,574 A | * | 6/1959 | Dahlberg | 137/577 |
| 3,832,854 A | * | 9/1974 | Metts | 210/170 |
| 3,918,483 A | | 11/1975 | Van Leeuwen | |
| 4,298,470 A | | 11/1981 | Stallings | |
| 4,522,533 A | * | 6/1985 | Campbell et al. | 405/40 |
| 4,605,501 A | | 8/1986 | Tyson | |
| 4,756,827 A | | 7/1988 | Mayer | |
| 5,154,353 A | | 10/1992 | Plachy | |
| 5,680,989 A | | 10/1997 | Plachy et al. | |
| 5,711,536 A | | 1/1998 | Meyers | |

* cited by examiner

*Primary Examiner*—John Rivell
(74) *Attorney, Agent, or Firm*—Charles G. Lamb; Middleton Reutlinger

(57) ABSTRACT

A flow leveling device for use in a liquid distribution system that can be attached to the end of a conduit The device has an eccentrically placed opening on the face of the device whose vertical position can be varied so as to equalize the flow of liquid dispersed from a central point. The device is secured to the conduit by a double-walled skirt depending from the face of the device. The skirt has a central gap defined by the double walls which securely holds the conduit walls therein.

23 Claims, 3 Drawing Sheets

FLOW LEVELING DEVICE

FIELD OF THE INVENTION

This invention relates to a device for equilibrating the flow of liquid out of a central container where the container may not be leveled and more particularly relates to an adjustable weir for fitting as a cap onto the inlet end of fluid distribution pipes originating in a wastewater junction box.

BACKGROUND OF THE INVENTION

In the treatment of wastewater and particularly wastewater that has been treated in a septic tank, or the like, the effluent from the septic tank is transferred into a drain field wherein the effluent is absorbed into the soil. In the preparation of these drain fields to it receive wastewater effluent, trenches are generally dug in a preselected arrangement and distribution pipes with drainage openings therein are laid into the trenches and covered with gravel, sand and soil.

In the initial treatment of wastewater, the wastewater flows into the septic tank from sewage disposal systems, such as toilets, and the solids settle to the bottom of the tank as the liquids move out through an outlet in the upper portion of the septic tank. The liquid separated from the solids in the septic tank is normally discharged as a partially clarified liquid into subsequent treatment containers including, for example, distribution or junction boxes. This water or liquid is then discharged from the junction boxes to the drain fields by means of distribution pipes exiting the junction boxes.

Sometimes when the junction boxes are installed, or after installation due to uneven settling of the soil, the disposition of the different entry ends of the distribution lines is not along the same vertical planes. The result is that during times of low fluid flow, the wastewater drains first out the distribution lines with entry ends positioned along the lowest vertical plane. This causes more wastewater to enter areas of the drain field served by the lower placed distribution lines and an unequal absorption and dissemination of the wastewater.

Besides unleveled distribution boxes, similar situations arise resulting in uneven distribution of fluids where even distribution or control over distribution is desired. For example, it is also desirable to regulate the flow of liquid through recirculation lines in media based treatment systems.

One solution to this type of problem is to provide flow-equalizing weirs that can be individually adjusted to vary the flow of liquid through each exit location. In septic systems with distribution lines, this can be accomplished through the use of end caps secured over the open ends of the distribution pipes within the junction box. The end caps have a variety of means of varying the height of an opening through the end cover. This permits leveling of all the openings in the distribution pipes within the junction box.

However, these devices often have multiple parts and use a complicated system of manipulating the height of the opening. Multiple parts require more expensive and difficult manufacturing techniques as well as being more difficult for the user to maneuver. Also, the means of securing the device to the distribution pipe has proven to be unsatisfactory. Typically, a single-walled skirt either wraps around or inserts into the distribution pipe. This does not usually provide a very secure fit, especially if there are slight variations in pipe diameter or pipe wall thickness. Also, this means of securing the device to the pipe requires different sized devices for every size pipe and even pipes of the same size with varying wall thickness must each use different devices.

SUMMARY OF THE INVENTION

It is accordingly a primary object of the present invention to provide an effective means for equalizing fluid flow out of unleveled containers.

More particularly, it is an object of the present invention to provide a height adjustable weir for liquid distribution systems.

Further, it is an object of the present invention to provide an end cover for the inlet end of fluid distribution pipes originating in a wastewater junction box and wherein the cover has an eccentrically placed opening which can be rotated to change the vertical level of the opening. The opening acts as a weir to promote the even distribution of wastewater out of the distribution box.

Even further, it is an object of the present invention to provide an end cover with an eccentrically placed opening for the inlet end of fluid distribution pipes that attaches to the distribution pipe end with a double-walled skirt attached to and extending outward from the end cover. The double-walled skirt allows for a more secure and watertight fit of the end cover to the pipe and flexibility as to the variance in pipe wall thickness accommodated by the skirt than does a single-walled skirt.

Another object of the present invention is to provide a junction box having at least one outlet wherein the outlet has a flow leveling device attached thereto.

BRIEF DESCRIPTION OF THE DRAWINGS

A better understanding of the invention will be had upon reference to the following description in conjunction with the accompanying drawings in which like numerals refer to like parts throughout the several views and wherein.

DETAILED DESCRIPTION OF THE PREFERRED EMBODIMENT

Figure 1:
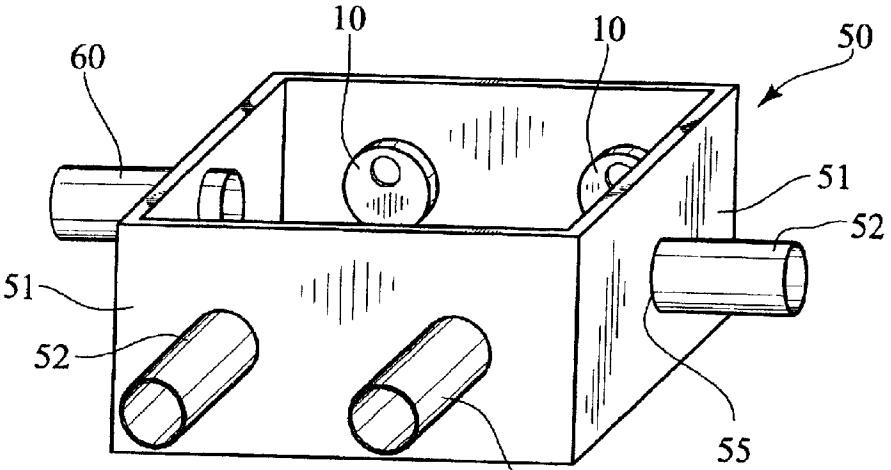
FIG. 1 is a perspective view of a junction box of the present invention.

In FIG. 1 is shown an example of a junction box 50 and attached fluid distribution pipes 52 for a wastewater treatment system. Wastewater flows from a septic tank through an effluent line 60 and empties into the junction box 50. The junction box 50 is of usual construction as is generally known in the art. It may include a removable top lid (shown removed) that permits access to the interior space of the junction box 50 and the flow leveling devices 10 attached to the entry ends 53 of the fluid distribution pipes 52. The junction box 50 has a plurality of openings 55 for attachment of fluid distribution pipes 52. Preferably, there is at least one opening 55 and attached fluid distribution pipe 52 for each side wall 51 of the junction box 50, exclusive of the side wall 51 having the opening 54 for the effluent line 60. There may be two or more openings 55 per side wall 51 to allow greater dispersion of the wastewater out of the junction box 50.

In use, the junction box 50 is placed in the soil or on whatever surface it will be supported by and is leveled as accurately as possible. The effluent line 60 as well as the various distribution pipes are inserted through the effluent line openings 54 and fluid distribution pipe openings 55, respectively, with the entry end of the fluid distribution pipe 52 extending a short distance into the junction box 50. Wastewater that enters the junction box 50 through the effluent line 60 will flow out from the junction box 50 through the plurality of distribution pipes 52 and empty into the drainfield. Sometimes, due to either inaccuracies in the initial leveling, or due to settling of the supporting surface over time, the junction box 50 will not be level. This results in water draining unevenly out of the junction box 50. In order to alleviate this problem, flow leveling devices 10 of the present invention are affixed to the entry ends 53 of the fluid distribution pipes. 52. The flow leveling device 10 is then rotated so that the eccentrically placed opening 30 on each device aligns along the same vertical plane, thus assuring even flow of the wastewater out of the junction box 50. The position of the eccentrically placed opening 30 may be adjusted as needed over time to return the flow pattern to the desired state.

Figure 3:
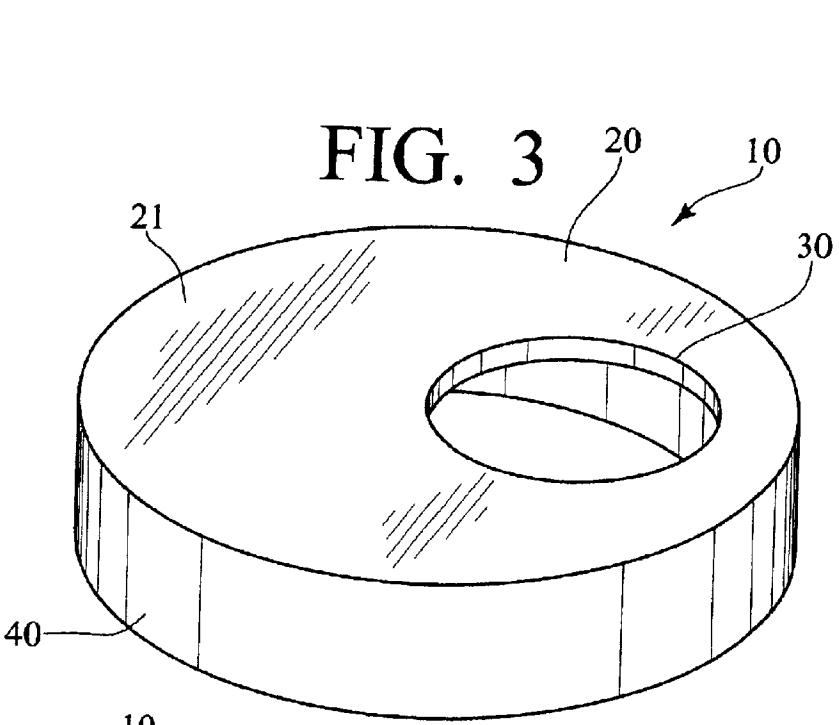
FIG. 3 is a perspective view of FIG. 2 from the inside of the flow leveling device of the present invention.
Figure 2:
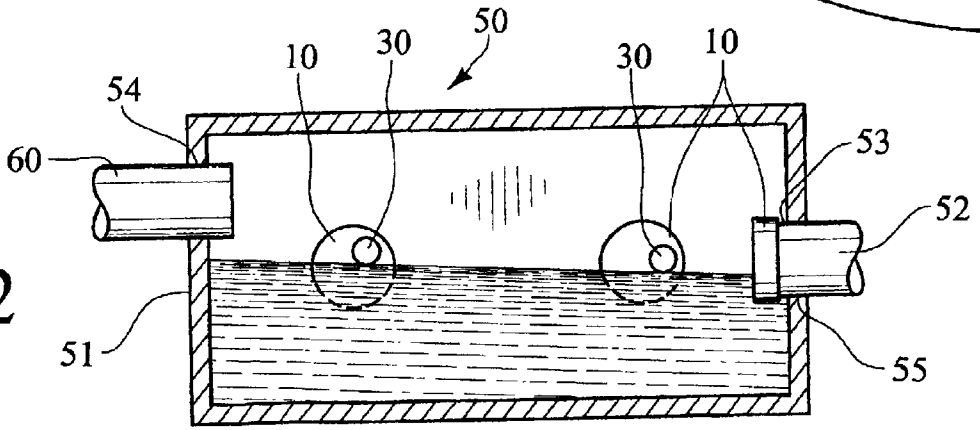
FIG. 2 is a perspective view from the outside of a preferred flow leveling device of the present invention.

As shown in FIGS. 2 and 3, an embodiment of the present invention comprises a flow leveling device 10 having an end closure 20. The end closure 20 is provided with a hole or opening 30 through which liquid flows. The hole 30 is placed offset, or eccentrically, from the center of the end closure 20. Depending from the end closure 20 is a double-walled skirt 40 that finctions to secure the flow leveling device 10 to the fluid distribution pipe 52. The fluid distribution pipe 52 slides into the interwall gap 44 formed between the double walls of the skirt 40 and is gripped and secured on the pipe's 52 interior and exterior wall surfaces thus holding the flow leveling device 10 securely to the fluid distribution pipe entry end 53.

The flow leveling device may be constructed as a unitary piece from rigid but pliable materials. The flow leveling device 10 may be constructed from plastics such as polypropylene or polyethylene having the required physical characteristics. Utilizing a unitary construction design permits ease of manufacture. For example, if an injection molding process is used to construct the flow leveling device 10, a single mold can be constructed and used to produce the entire device in one step. This greatly reduces cost over a device requiring two or more molds and an additional assembly step.

Figure 4:
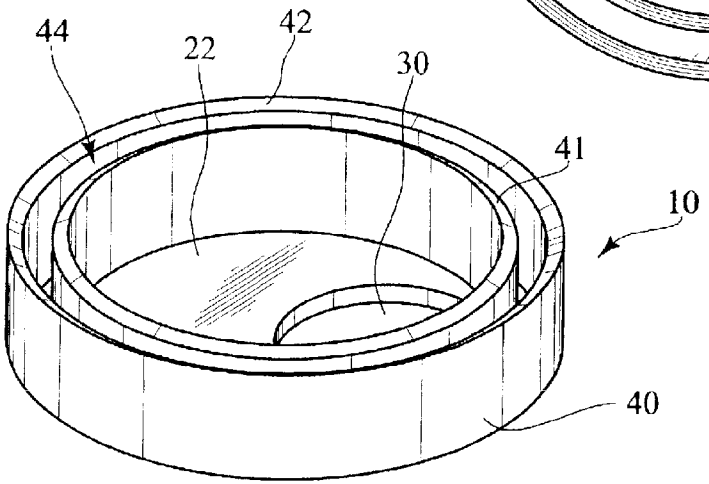
FIG. 4 is a bottom view of FIG. 2.

As shown in FIGS. 2, 3 and 4, the end closure 20 is comprised of an outer face 21 and an inner face 22. The outer face 21 faces into the junction box 50 and has direct and initial contact with the wastewater in the junction box 50. The inner face 22 is directed toward the interior of the fluid distribution pipe 52. Depending from the outer periphery of the inner face 22 is the double-walled skirt 40, which secures the entry end of the fluid distribution pipe 52 to the end closure 20. The eccentrically placed opening 30 is placed near the periphery of the end closure and the flow leveling device 10 can be rotated so as to level the flow of waste water between all the fluid distribution pipes 52 exiting the junction box 50.

Figure 8:
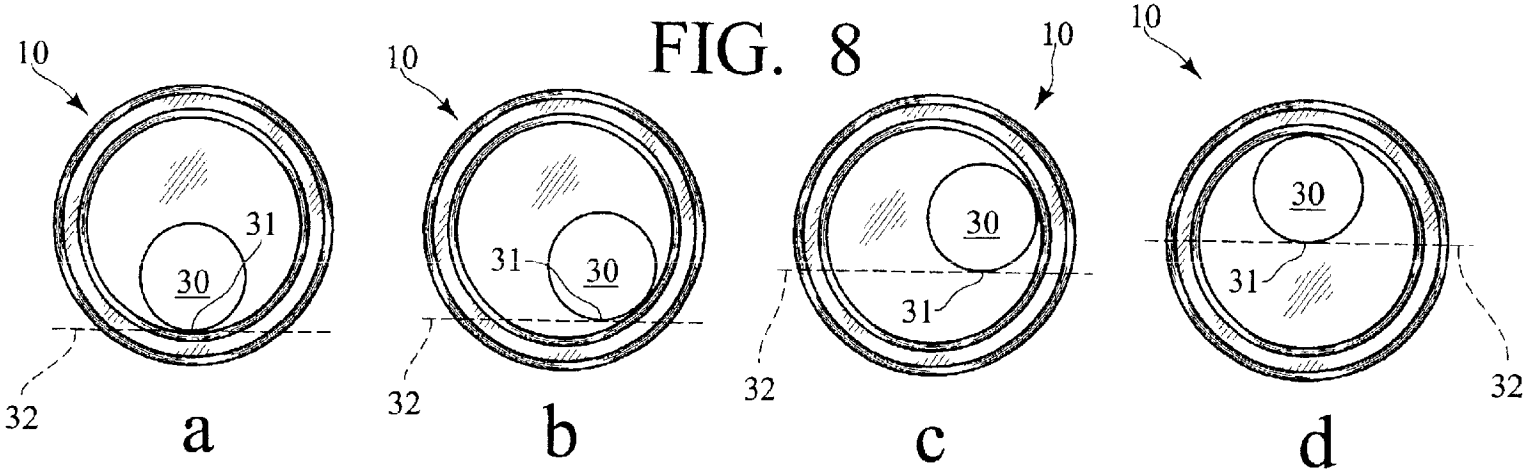
FIGS. 8*a, b, c*, and *d* are end elevation views of a flow leveling device of the present invention secured to a pipe end and showing different radial positions of the opening along different vertical planes.

The eccentrically placed opening 30 is positioned on the end closure 20 offset from the center and near the periphery so as to form a weir that restricts the flow of wastewater into the fluid distribution pipe 52 and out of the junction box 50. As demonstrated in FIGS. 8*a, b, c*, and *d*, the wastewater level 32 must rise to the level of the lowermost edge 31 of the opening 30 before it can enter into a particular distribution pipe 52 to which the flow leveling device 10 is attached. By rotating the flow leveling device 10, the vertical plane on which the lowermost edge 31 resides is altered relative to the level of the: wastewater either permitting or inhibiting the free flow of liquid into the distribution pipe 52. If a particular junction box 50 is not level, the flow of wastewater out of the junction box 50 and into the distribution pipes 52 attached to the different side walls 51 will be unequal, resulting in one or more drain fields receiving more or less fluid than the rest. Utilizing flow leveling devices 10 secured to each of the entry ends 53 of all the fluid distribution pipes 52 exiting from the junction box 50, the lowermost edge 31 of each opening 30 can be adjusted so that each lies in the same vertical plane. This will create equal distribution of wastewater into each of the fluid distribution pipes 52, resulting in an equal volume of fluid entering each point of the drain field or fields. It may also be desirable to have an unequal flow of fluid into one or more fluid distribution pipes 52. If such is the case, one or more flow leveling devices 10 may be rotated so that the lowermost edge 31l of the opening 30 rests on a different vertical plane than another flow leveling device 10. This will cause fluid to first enter the distribution pipe 52 with a flow leveling device having a lowermost edge 31 along the lowest vertical plane. Wastewater will not enter other fluid distribution pipes 52 until the overall fluid level within the junction box 50 rises to the lowermost edge 31 of each opening 30. The overall result is an unequal distribution of wastewater volume through the fluid distribution pipes 52. Thus, rotating flow leveling device 10 in order to change the vertical level of the eccentrically placed opening 30 allows the user to accurately control the flow of fluid out of the junction box 50 and into the fluid distribution pipe 52.

Figure 7B:
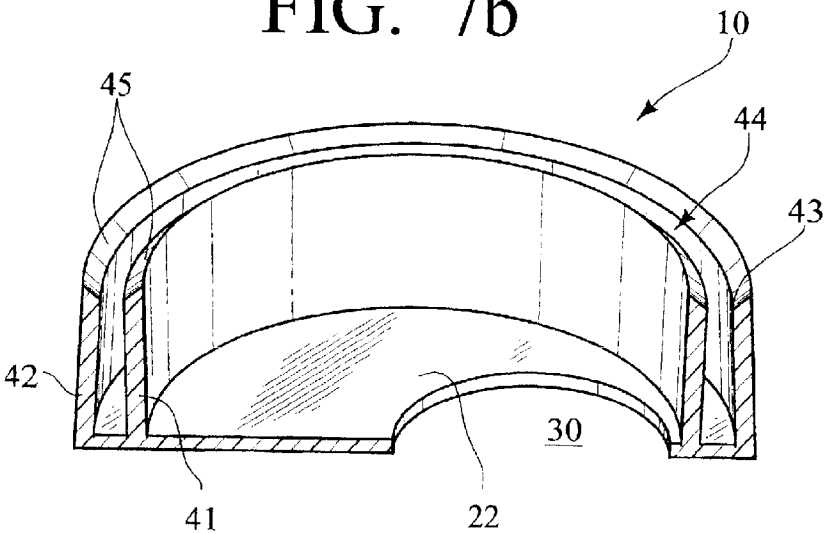
FIG. 7*b* is a cross-sectional view of another embodiment of a flow leveling device of the present invention showing the inner and outer walls in detail.
Figure 7A:
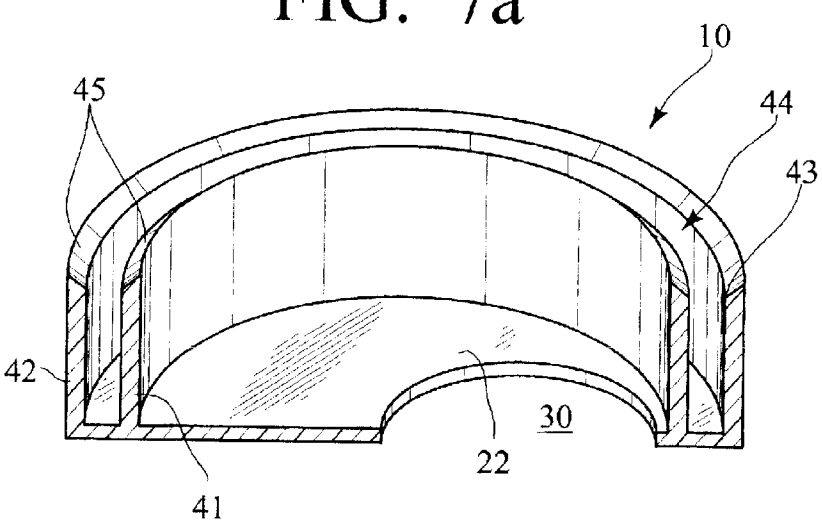
FIG. 7*a* is a cross-sectional view of an embodiment of a flow leveling device of the present invention showing the inner and outer walls in detail.

FIGS. 3 and 4 best illustrate the double-walled skirt 40 depending from the periphery of the inner face 22 of the end closure 20. The inner wall 41 and outer wall 42 of the skirt 40 both depend and extend outward from the inner face of the end closure 22 for a distance necessary to securely support and hold the flow leveling device 10 to the end of a fluid distribution pipe 52. As shown in FIGS. 3, 4 and 7*a*, the inner wall 41 and outer wall 42 can depend parallel relative to each other from the inner face 22 and perpendicular to the inner face 22 of the end closure 20. In an alternative embodiment, as shown in FIG. 7*b*, the inner wall 41 and outer wall 42 may depend at an inward angle relative to each other from the inner face of the end closure 22. In another embodiment, not illustrated in the figures, only one of the walls 41 and 42 may be biased toward the other. The extent of the angle may vary up to an angle resulting in the upper ends 43 touching or nearly touching, as illustrated in FIG. 7*b*. Regardless of the angle of the inner wall 41 and outer wall 42 relative to each other, a space between the walls, or interwall gap 44 is created. The interwall gap 44 accommodates the entry end 53 of the fluid distribution pipe 52. The inner wall 41 and outer wall 42 snugly grasp the entry end 52 of the fluid distribution pipe 52 and hold the flow leveling device securely to the distribution pipe 52. The distance between the walls 41 and 42 creating the interwall gap 44 is selected so as to snugly accommodate the thickness of the distribution pipe 52. Double walls possess an advantage over single walls fitting either around or inside a pipe in that with double walls the pipe is held more securely. An outer wall is in direct contact with the exterior surface of a pipe while an interior wall directly contacts an interior wall. The extra contact results in twice as much frictional contact with the surfaces of a pipe, resulting in a "vice-like" securing of the flow leveling device 10 to the distribution pipe 52.

Utilizing angled walls 41 and 42 as shown in FIG. 7*b* allows for a greater variation in accommodated pipe wall diameters. The angled walls 41 and 42 can be semi-rigid yet flexible enough to permit a pipe 52 of varying diameter to be pushed between the slight gap of the walls 41 and 42, biasing the walls 41 and 42 apart just enough to permit passage of the entry end 53 of the pipe 52 and further down until stopping at the inner face 22 of the end closure 20. The tension created by biasing the walls 41 and 42 apart results in a greater pressure holding the pipe end 53 in the interwall gap 44 than would exist without the biasing. The distance between the walls 41 and 42 is greater toward the wall end depending from the inner face 22 of end closure 20 and as such, a pipe end 52 having a greater wall thickness will still fit within the interwall gap 44 that also accommodates a smaller wall thickness pipe. For example, in one embodiment of the device of the present invention, the flow leveling device 10 can be secured to both thin-walled SDR 35 piping having a minimum wall thickness of 0.12 inches +/−10% as well as Schedule 40 piping having a wall thickness of 0.296 inches.

Again referring to FIGS. 7*a* and 7*b*, in another embodiment of the present invention, the top edges 43 of the inner wall 41 and outer wall 42 can have beveling 44. The beveling 44 provides a larger area of insertion for the entry end 53 of the fluid distribution pipe 52 and makes it easier to insert and guide the entry end 53 into the interwall gap 44. The angle of the beveling may vary as necessary to accommodate different needs of the user.

Figure 5:
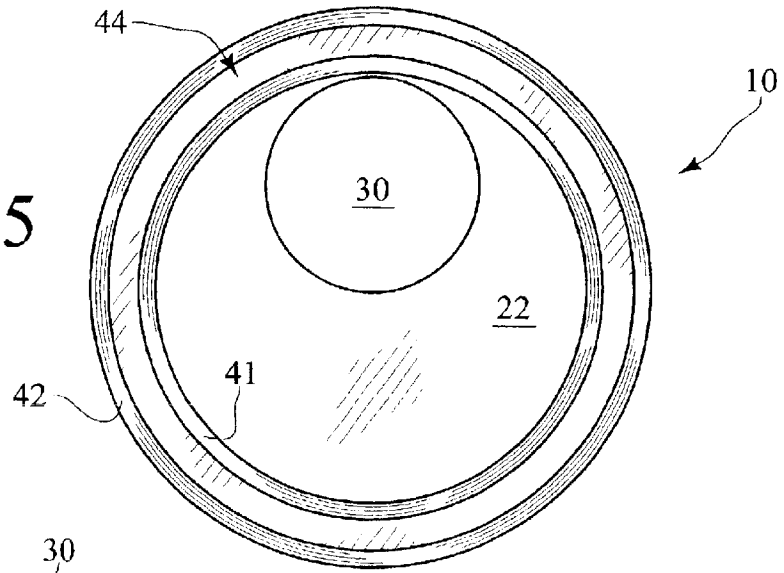
FIG. 5 is a top view of a second embodiment of a flow leveling device of the present invention.
Figure 6:
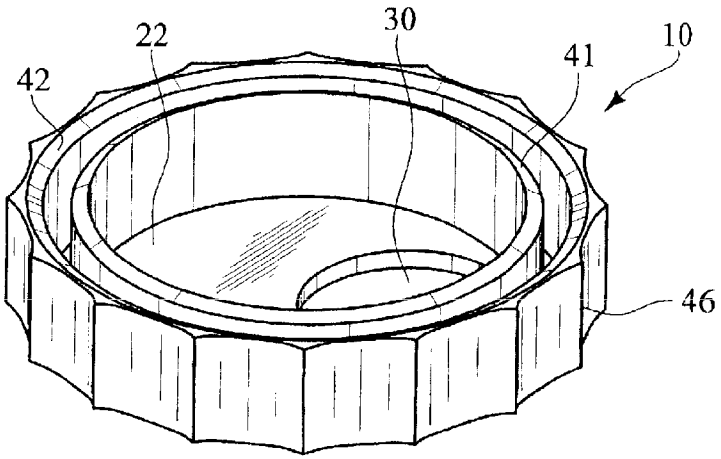
FIG. 6 is a bottom view of FIG. 5.

FIGS. 5 and 6 demonstrate a further embodiment of the device of the present invention. Either the outer periphery of the outer face 21 of the end closure 20 or the entire outside surface of the outer wall 42 can have gripping ridges 45 that assist the user in applying a rotational force to the flow leveling device 10. The user may need to apply this force when initially securing the flow leveling device 10 to the fluid distribution pipe 52, or at a later time when necessary to adjust the position of the opening 30. The gripping ridges 45 may have a scalloped appearance, or other such design as is necessary to facilitate a better grasp by the user on the flow leveling device 10.

The device may be used in any system where control over the flow of fluids is desirable. For example, the device may be used in recirculation lines from media based treatment systems. In a recirculation device for wastewater treatment systems, filtered effluent is shunted in two different directions. A fraction of the effluent is sent to the drainfield and percolated into the ground while a second fraction is directed back to the beginning of the system for further filtering. The recirculation device has a return line from a media based treatment location. The return line has a multiplicity of recirculation valves that work to divide the wastewater and distribute it in different directions. The device of the present invention may be fitted onto these valves. By adjusting the device, more or less of the wastewater may be directed in one or another direction.

The foregoing detailed description is given primarily for clearness of understanding. No unnecessary limitations are to be understood therefrom for modifications will become obvious to those skilled in the art upon reading this disclosure and may be made without departing from the spirit of the invention and scope of the appended claims.

What is claimed is:

1. A flow leveling device for liquid distribution systems, comprising:

a) an end closure having an inner face;

b) an opening eccentrically placed in said end closure;

c) a skirt extending inwardly from said inner face of said end closure, said skirt having an outer wall spaced from an inner wall said space between said outer wall and said inner wall being sized so as to receive and securely bind an entry end of a fluid distribution pipe therebetween.

2. The flow leveling device of claim 1, said end closure having an outer face directed away from said conduit and a peripheral edge.

3. The flow leveling device of claim 2, said peripheral edge having gripping ridges.

4. The flow leveling device of claim 1, said outer wall having gripping ridges on an exterior face.

5. The flow leveling device of claim 1, wherein at least one of said inner wall and said outer wall have a beveled edge on an end wherein said beveled edge is on an end farthest from said end closure inner face.

6. The flow leveling device of claim 5, said outer wall and said inner wall having a beveled edge on an end wherein said beveled edge is on an end farthest from said end closure inner face.

7. The flow leveling device of claim 1, said flow leveling device being constructed as a single unit.

8. The flow leveling device of claim 1, said flow leveling device being constructed from a semi-rigid material.

9. The flow leveling device of claim 8, said semi-rigid material being a plastic.

10. The flow leveling device of claim 9, said plastic being selected from a group consisting of polypropylene and polyethylene.

11. The flow leveling device of claim 1, said space between said outer wall and said inner wall decreasing from said inner face in an inward direction.

12. A flow leveling device for liquid distribution systems, comprising:

a) an end closure having an outer face and an inner face;

b) an opening eccentrically placed in said end closure;

c) a substantially non-pliable skirt extending inwardly from said inner face of said end closure, said skirt having a first wall spaced from a second wall, said space between said first wall and said second wall being sized so as to receive and securely bind an entry end of a fluid distribution pipe therebetween; and d) a beveled edge on an end furthest from said end closure of at least one of said walls of said skirt.

13. A junction box for wastewater treatment systems, comprising:

a) a junction box having at least one inlet opening and one outlet opening;

b) a flow leveling device rotatably attached to said outlet opening, said flow leveling device comprising;

i) an end closure having an inner face;

ii) an opening eccentrically placed in said end closure;

iii) a skirt extending inwardly. From said inner face of said end closure, said skirt having an outer wall spaced from an inner wall, said space between said outer wall and said inner wall being sized so as to receive and securely bind an entry end of a fluid distribution pipe therebetween.

14. The junction box of claim 13, said end closure having an outer face directed away from said conduit and a peripheral edge.

15. The junction box of claim 14, said peripheral edge having gripping ridges.

16. The junction box of claim 13, said outer wall having gripping ridges on an exterior face.

17. The junction box of claim 13, wherein at least one of said inner wall and said outer wall have a beveled edge on an end wherein said beveled edge is on an end farthest from said end closure inner face.

18. The junction box of claim 17, said outer wall and said inner wall having a beveled edge on an end wherein said beveled edge is on an end farthest from said end closure inner face.

19. The junction box of claim 13, said flow leveling device being constructed as a single unit.

20. The junction box of claim 13, said flow leveling device being constructed from a semi-rigid material.

21. The junction box of claim 20, said semi-rigid material being a plastic.

22. The junction box of claim 21, said plastic being selected from a group consisting of polypropylene and polyethylene.

23. The junction box of claim 13, said space between said outer wall and said inner wall decreasing from said inner face in an inward direction.

* * * * *